United States Patent [19]

Valentian et al.

[11] 4,328,667

[45] May 11, 1982

[54] FIELD-EMISSION ION SOURCE AND ION THRUSTER APPARATUS COMPRISING SUCH SOURCES

[75] Inventors: Dominique R. Valentian, Mantes la Jolie, France; Cesare M. Bartoli, Voorhout, Netherlands; Heinrich A. Pfeffer, Noordwijk, Netherlands; Hans-Joachim Herhudt V. Rohden, Oegstgeest, Netherlands; Duncan Stewart, Slough, England

[73] Assignee: The European Space Research Organisation, Paris, France

[21] Appl. No.: 25,348

[22] Filed: Mar. 30, 1979

[51] Int. Cl.[3] ..... F03H 1/00

[52] U.S. Cl. ..... 60/202; 313/163; 313/231.41; 313/328

[58] Field of Search ..... 60/202; 313/163, 359, 313/362, 231.4, 328

[56] References Cited

U.S. PATENT DOCUMENTS

| | | | |
|---|---|---|---|
| 2,809,314 | 10/1957 | Herb | 60/202 |
| 3,116,433 | 12/1963 | Yeates | 60/202 |
| 3,157,988 | 11/1964 | Schultz | 60/202 |
| 3,187,179 | 6/1965 | Craig et al. | 313/362 |
| 3,233,404 | 2/1966 | Huber et al. | 60/202 |
| 3,475,636 | 10/1969 | Eckhardt | 60/202 |
| 3,579,011 | 5/1971 | Hyman | 313/163 |
| 4,088,919 | 5/1978 | Clampitt et al. | 313/362 |

*Primary Examiner*—Robert E. Garrett

*Attorney, Agent, or Firm*—Daniel M. Rosen

[57] ABSTRACT

A field-emission ion source in which, under the influence of an electric field, ions are released from a metal or metal alloy present in an enclosed space in the liquid state. The ions are emitted from this space through a very narrow slit. This slit may be straight or curved. The field-emission ion source can be used in an ion thruster apparatus comprising an emitter module, an electrode system, and a power supply unit. A plurality of emitter modules can be combined to form an ion thruster apparatus having a greater ion current output. Instead of a liquid metal as the propellant, a metal in the solid phase can be supplied to the emitter module, which metal is melted in the emitter module.

12 Claims, 14 Drawing Figures

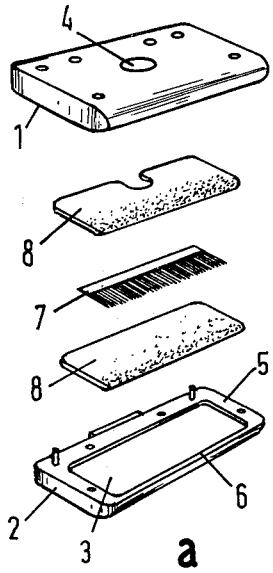
FIG.1
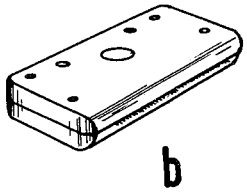
FIG.2
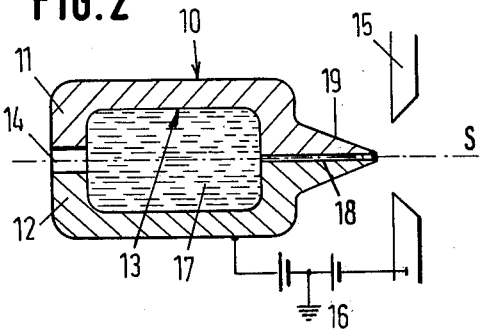
FIG.4
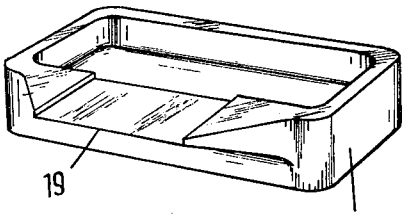
FIG.5
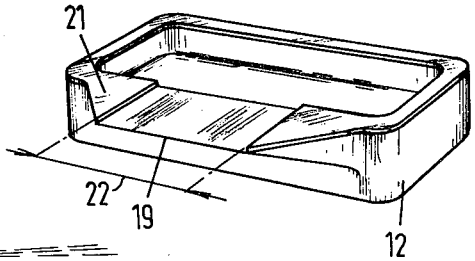
FIG.3
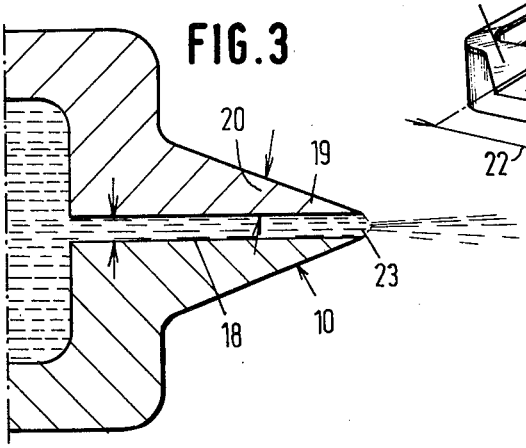

FIELD-EMISSION ION SOURCE AND ION THRUSTER APPARATUS COMPRISING SUCH SOURCES

The present invention relates to field-emission ion sources and ion thrusters comprising such sources.

It is described in the literature that ions can be emitted from a source when a liquid conductor—a metal or an alloy of metals in that source—is subjected to a sufficiently strong electric field—about 0.5 V/Å—of correct polarity. Electrons are repelled into the liquid, thereby leaving ions which are then accelerated by the electric field. This stream of ions can provide a reaction force on the source itself. The reaction force can be applied as a propulsion force in space vehicles. Field-emission ion sources can also be used for ion implantation or general ion beam technology.

STATE OF THE ART

A well-known field-emission ion source is described in British patent specification No. 1,442,998. This ion source comprises an array composed of a number of nickel or tungsten needles. The tips of these needles provide the ion emitting points. The array is clamped between two stainless steel plates, held together by suitable means such as bolts and nuts. The gap between the plates forms a reservoir for the liquid ion source material. When an electric field of sufficient strength is generated between the tips and a suitable electrode system, so-called Taylor cones of liquid propellant are created. The tips of these Taylor cones are sharp enough to allow field emission there.

Flow of liquid metal or propellant to the needle tips is provided by capillary forces through the spaces between the needle array and the two plates which form the propellant reservoir. These capillary forces allow replenishment of the emitted propellant and the ion source can operate for an indefinite time.

This known ion source design shows several drawbacks. It was found to be very difficult to manufacture emission arrays sufficiently accurate to provide regular emission patterns and to provide a homogeneous film of liquid on the surface of the array. Adequate wetting of the array by the metal propellant has turned out to be difficult, because the propellant has to creep along the external surface of the needle array. The exposed surface of liquid propellant is also subject to evaporation causing undesirable propellant losses.

The main object of the invention is to provide a field-emission ion source in which these drawbacks have been overcome.

It is a further object of the present invention to provide an ion thruster apparatus in which a plurality of field-emission ion sources can be combined into a ion thruster apparatus in a simple manner.

SUMMARY OF THE INVENTION

According to the present invention, there is provided a field-emission ion source, also called emitter module, comprising a housing containing a hollow space in communication with a passage suitable for supplying a metal or metal alloy to said hollow space, and with a slit for discharging said metal in the liquid phase from the hollow space, the discharge slit having a width of no more than 0.020 mm.

Preferably, the housing consists of two complementarily shaped flat halves, each having a recess in the surface facing the other half to form the enclosed hollow space, the discharge slit being located in the plane of division of the two halves, which halves are, beside the supply passage and the discharge slit, interconnected liquid-tight, the outer wall of each half adjacent to said slit making an acute angle with said plane of division. This acute angle is preferably smaller than about 30°.

The discharge slit may be straight or curved.

The emitter module together with an associated storage and feeding system, an electrode system and a power supply unit forms an ion thruster apparatus. When an emitter module with a linear discharge slit is used, the associated electrode gap opposite the ends of the discharge slit of the emitter is preferably broadened to avoid irregular ion concentrations at the ends of the emitter discharge slit.

The use of a field-emission ion source according to the invention makes it possible to combine a plurality of these emitter modules in a simple manner to form an ion thruster apparatus having a higher output current. According to the invention a pluraity of emitter modules and an electrode system adapted thereto can be connected to one power supply unit, with the emitters being connected through a conduit system to one and the same supply container, comprising a heater for liquefying of the metal propellant contained therein, which liquid metal is supplied through the conduit system to all emitters. Each emitter module can also be provided with means for melting or solidifying the metal propellant in the emitter module.

Instead of the metal being supplied to the emitter modules in liquid form, it is also possible, according to the present invention, for a metal or alloy to be supplied to the emitter in the form of a wire or foil, the metal supplied being converted within the emitter cavity into a liquid propellant by means of a heating element.

BRIEF DESCRIPTION OF THE DRAWINGS

The above and other features of the invention will now be described in more detail with reference to the accompanying drawings, in which:

FIG. 1*a* is an exploded view of a known elementary emitter module;

FIG. 1*b* is an assembled view of the emitter module of FIG. 1*a;*

FIG. 2 is a schematic drawing, partly in section, of an emitter module according to the present invention, combined with an electrode and a power supply unit to form an ion thruster apparatus;

FIG. 3 illustrates, on an enlarged scale, the discharge slit and the form of the housing adjacent to this slit of an emitter module;

FIGS. 4–5 illustrate the bottom part of the housing of an emitter module as shown in FIG. 2, to illustrate various manners in which the discharge slit can be formed;

DESCRIPTION OF THE DRAWINGS

Figure 6:
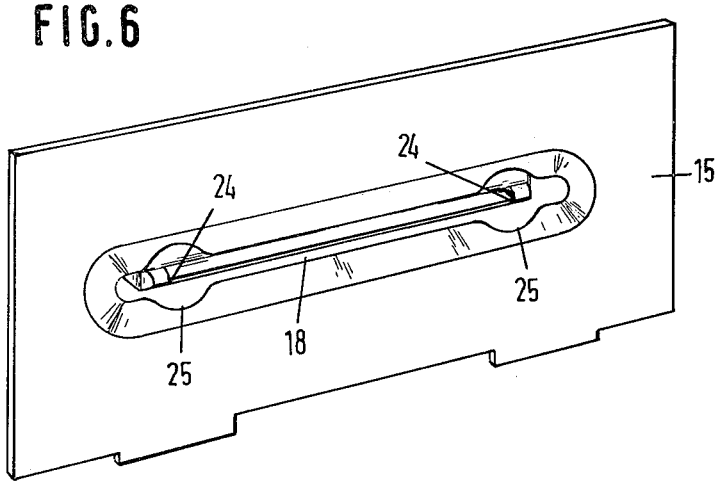
FIG. 6 is a perspective view of an electrode as illustrated in FIG. 2.

FIGS. 1*a–b* show an exploded and an assembled view of a known elementary emitter module which together with a suitable formed electrode system can be used as a field-emission ion thruster. This emitter module comprises two steel bodies 1,2, which are both partly cut out to form a cavity 3 for the metal propellant, which is fed into this cavity by means of a filling orifice 4 in body 1. The bodies 1,2 are bolted together; a gasket may be placed between the two bodies 1,2 on the circumferential edges 5, except for the front edge 6 of this circumference in order to provide a gap for the array 7. When no sealing gasket is used, a small amount of material has to be removed from one or both bodies 1,2 at the front edge 6 in order to provide a gap for the array 7. The thickness of the array 7 is normally of the order of 50 μm, the gap at the front edge 6 slightly exceeding this thickness. The array 7 is clamped between two sponges 8 of a porous metal to enhance the capillary feeding action to the array 7.

FIG. 1*b* shows the elementary emitter module in the assembled state. The array tips are just visible.

In FIG. 2–3 a field-emission ion thruster of basic linear form according to the invention is shown schematically. The emitter module 10 is connected to an electrode system 15 by means of a power supply 16. The positive pole of the power supply unit 16 is connected to the emitter 10, the negative pole to the extraction electrode 15, since ions have to be extracted from the emitter 10. The emitter module 10 consists of two halves 11,12 together forming a housing assembly with a cavity 13, to which the metal propellant can be fed through an orifice 14. The cavity 13 may be filled with a porous metal 17 in order to enhance capillary action to the emission slit 18 of the emitter module 10.

The halves 11,12 are machined out of a metal such as stainless steel, tungsten or molybdenum, which allows grinding of very sharp edges 19, the angles 20 of which should be as small as possible, preferably smaller than 30°.

The width of the narrow slit 18 between the two edges 19 of the halves 11,12 is in the order of 0.020 mm or less. Good emission results have been found with slits, having a width of 0.004 mm. These very narrow slits 18 can be obtained by either one of the following methods:

by lapping away a small amount of material on one or both of the halves 11,12 (FIG. 4) or by mounting a gasket 21 between the two halves 11,12, except for the slit region 22 of the edge 19. This gasket 21 can be a loose foil of metal or may be deposited onto one of the halves 11,12 by suitable electrical or chemical methods (FIG. 5).

The length 22 of the emission slit 18 is dictated by the ion current desired and basically any length is possible.

Surprisingly it has been found that the metal propellant present at the apex of the sharp edges 19 shapes itself into regularly spaced and stable Taylor cones 23 (FIG. 3), their spacing and the ionic current emitted therefrom being a function of the overall electrode geometry—mainly the shape of the edges 19 of the emitter module 10 and that of the extraction electrode 15—and the potential difference applied between emitter module 10 and extraction electrode 15.

A linear emitter module shows irregular excessive emission effects at both ends of the linear slit 18. To avoid these so-called "end effects" the electric field values at both ends of the linear slit can be lowered by progressively widening the distance between the extraction electrode 15 and the emitter edge 19. FIG. 2 shows an extraction electrode 15 in section. FIG. 6 shows a perspective view of extraction electrode 15, seen in the direction of the slit 18 of the emitter module 10. Opposite the ends 24 of the slit 18 circular or elongated holes 25 manufactured in the extraction electrode 15.

Figure 7:
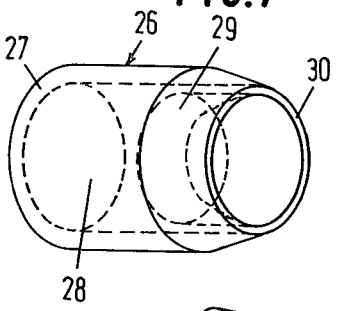
FIGS. 7–8 diagrammatically show emitter modules having a circular discharge slit.
Figure 8:
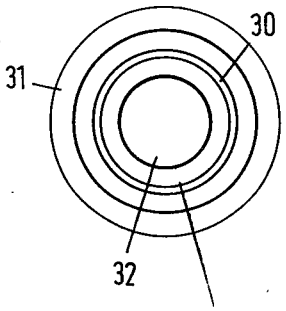

Though the emitter module basically is of linear shape, it is possible to modify the linear geometry into a curved slit configuration as shown schematically in FIG. 7. The emitter module 26 has the shape of a hollow cylinder with a closed bottom 27 and a reservoir cavity 28. At the opposite end cavity 28 is closed by a cylindrical element 29. Between the outer and the inner cylindrical parts a slit 30 is formed, showing the same sharp edges as the linear emitter module 10. With this emitter configuration "end effects" as encountered in linear slits can be eliminated. The shape of the extraction electrode is of course adapted to the shape of the emitter. The electrode therefore will comprise a closed outer ring 31 and a circular disc 32, both surrounding the circular slit 30 of the emitter module 26.

Figure 9:
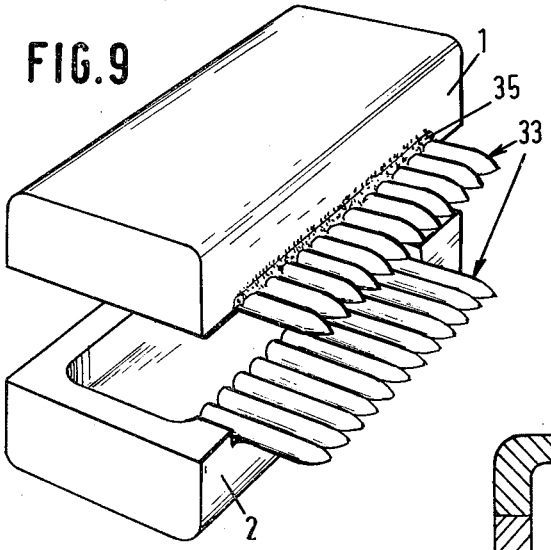
FIGS. 9–10 show a variant of the emitter module of FIG. 2, using two arrays of emitting points.
Figure 10:
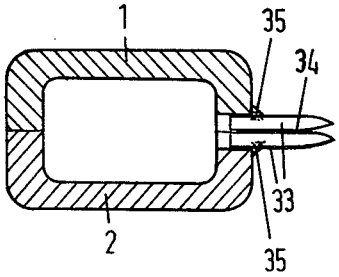

Useful thrust results could also be obtained with a version of the emitter module in which the presence of a linear slit is combined with the known array type ion source (FIGS. 9–10). Two arrays 33 of sharpened wires are used in which the wires of each array 33 are in close contact with each other. The arrays are enclosed in metal bodies 1,2 of the same type as shown in FIG. 1. Between the two arrays 33 a slit 34 is formed by the interstices of the individual wires of the arrays. No propellant is allowed to flow over the external faces of the arrays owing to the interface of each array 33 being entirely sealed to its respective half, as shown at 35. In this manner the good feeding characteristics of the slit type emitter are combined with the good ion emission characteristics of the array type emitter.

Figure 11:
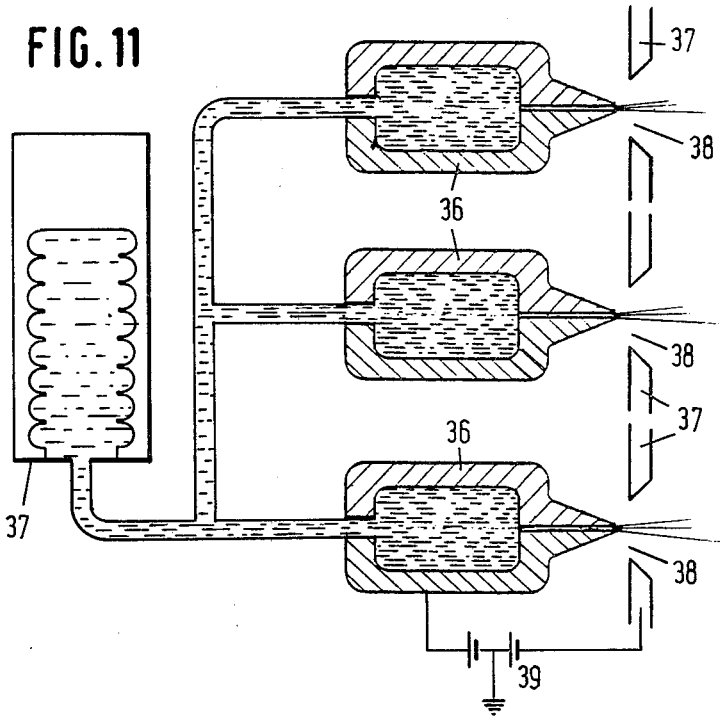
FIG. 11 shows a group of emitter modules with accompanying electrode system connected to a single supply vessel for the liquid propellant.
Figure 12:
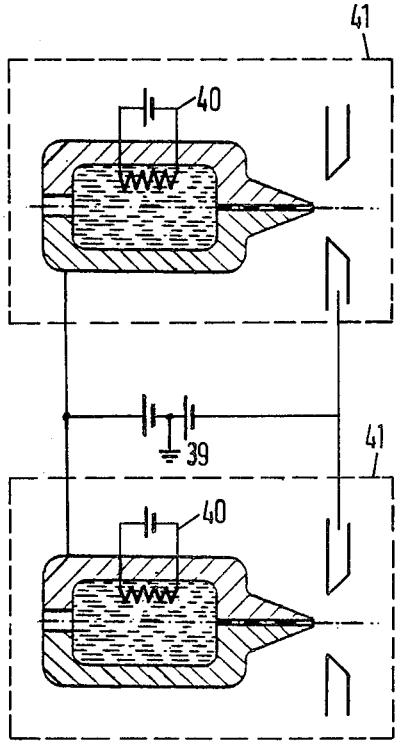
FIG. 12 is a diagrammatic view showing two emitter modules connected to the same source of voltage.

The linear emitter module shows a thrust density in the order of 1 mN/cm and normally has a slit of a few centimeters in length. To achieve a sufficient thrust a plurality of emitters will have to be used. It has been found that with slit type emitters several emitter modules 36 can be connected to a single common propellant source 37 (FIG. 11). By so combining or clustering several emitters any range of ion current can be achieved by operating together the required number of emitters, saving much mass and volume, which is especially of importance in space-applications. All emitter modules 36 are at the same potential and the extraction electrode is provided with a number of orifices 38 corresponding to the number of emission slits. A single power supply unit 39 allows the operation of a complete cluster of emission modules 36. Such a single power supply unit 39 (FIG. 12) also allows a further simplification with respect to conventional ion engine systems, where each engine or ion source requires its own power supply which must be switched on and off. The power supply unit 39 delivers a potential difference in the order of 2–12 kV. Instead of switching individual power supply units on and off, it is much simpler to switch off the individual heating elements 40 of each emitter module or cluster of emitter modules. The heating elements 40 deliver just sufficient power to keep the metal propellant in the liquid state. With a heating element 40 switched off the liquid propellant becomes solid and the emitter does not operate as a thruster any longer. The power supply unit 39 remains connected to the switched off emitter module 41 or cluster of emitter modules. In this way it becomes easy to operate the desired thruster when the ion sources are used as a space propulsion device. Instead of heating elements 40 to keep the metal propellant in the liquid phase, cooling elements (not shown) can be used to solidify the liquid propellant.

Several refinements can be applied to enhance the functioning of the emitter modules. Good ion emission properties require a regular supply of propellant at the very end of the sharp emitter edges in order to form the Taylor cones 23, so that the liquid surface can effectively be acted upon by the electrostatic field.

Figure 13:
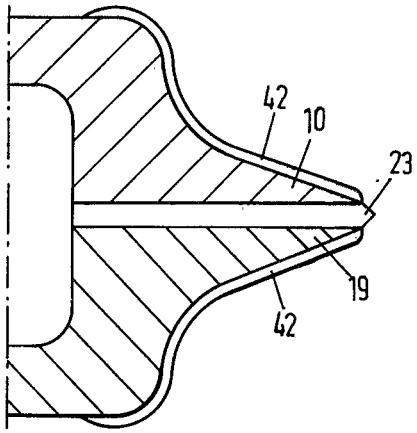
FIG. 13 illustrates the edge of an emitter module of FIG. 2, provided with a protective layer.

Usually this is achieved by choosing a construction material for the emitter module 10, which is easily wetted by the propellant. The drawback of such easily wetted material is that the external surfaces of the sharp emitter edges 19 can also become coated with liquid metal, which may lead to sparking and neutral propellant evaporation losses. To prevent undesirable propellant creeping, the external sides of the sharp edges are coated with a surface film 42 (FIG. 13) which is not wetted by the propellant. This film can be a layer of oxide or of boride, nitride, carbide etc.

Alternatively the whole emitter body can be made of a material that is not wetted by the propellant and only the flow passages which must be wetted for good propellant feeding—the inside of the slit and of the housing—are treated with a layer of metal which allows good wetting.

It has been observed that good wetting can require elaborate surface cleaning treatments to achieve initial wetting of the emitter by the propellant. Once initial wetting has been achieved and the propellant subsequently removed from the emitter body, wetting is much more easily achieved. This "preconditioning" of the emitter module is important since reliable wetting of an emitter, mounted in a spacecraft, can thus be obtained.

The liquid propellant must be fed into the thin emission slit for emission to take place. Usually the propellant is stored in a separate tank in the liquid state and made to flow to the emission edge or slit either by capillary forces or by slightly pressurizing the propellant system. (FIG. 11).

Figure 14:
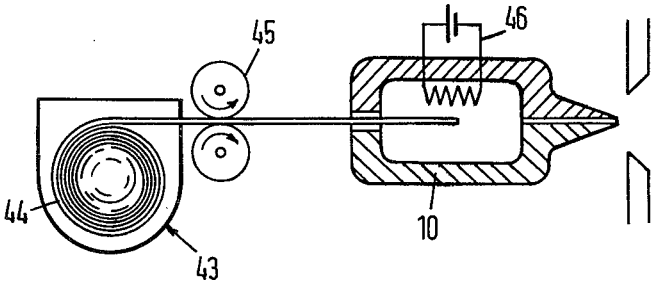
FIG. 14 shows a variant of an ion thruster apparatus according to FIG. 2, in which, instead of a liquid metal, a metal in the solid phase is supplied to the emitter module.

FIG. 14 shows an alternative feeding system, in which the propellant metal is stored in the solid phase in a housing 43, either as a thin wire or as a sheet 44, which is mechanically fed by suitable means, such as a stepping motor 45, into the emitter module 10. A heating element 46 is present in the emitter module 10 to melt the solid metal, so it can flow therefrom as a liquid to the emission slit as previously described.

What we claim is:

1. A field-emission ion source, comprising a housing containing a hollow space in communication with a passage suitable for supplying a metal or metal alloy to said hollow space, said housing having a slit in contact with said metal or metal alloy in said hollow space and operative to discharge said metal in the liquid phase from said hollow space, said discharge slit having a width of no more than 0.020 mm.

2. A field-emission ion source as claimed in claim 1, wherein the housing comprises two complementary shaped, flat halves, each of which has a recess in the surface facing the other half to form said hollow space, said slit being located in the plane of division of said two halves, which halves are interconnected in liquid-tight fashion, the outer wall of each half of the housing adjacent to the slit making an acute angle with said plane of division.

3. A field-emission ion source as claimed in claim 2, wherein said acute angle is smaller than 30°.

4. A field-emission ion source as claimed in claim 1, wherein said housing comprises a hollow cylindrical outer housing member closed on one side by a bottom, and a second cylindrical housing member provided within said outer housing member to form a hollow space, there being provided an annular discharge slit between the two housing members.

5. A field-emission ion source comprising two complementary shaped, substantially flat housing bodies provided at the facing surfaces with a recess to form an enclosed hollow space in communication with a supply passage and with a slit-shaped passage located in the plane of division of the two housing bodies, the two housing bodies being interconnected in liquid-tight fashion except for said supply passage and said discharge slit, each housing body being provided at the edge facing the supply slit with an array of thin wires having a sharp end, the interstices between the wires being sealed and each array being adhered to the associated housing body, the arrangement being such that, in the assembled condition, a slit is formed between the two arrays and so that the liquid metal can only reach the tips of the wires through said slit.

6. An ion thruster apparatus comprising a field-emission ion source or emitter module according to claim 2 or 5, a propellant storage and feeding system, an electrode system arranged in spatial relationship to said ion source, and a power supply unit connected to both said emitter module and the electrode system and capable of generating a voltage difference of some kV between the emitter and the electrode system, the electrode system being provided with a slit-shaped ion passage orifice arranged parallel and symmetrically to the emitter slit, said passage orifice being widened at its two ends.

7. Apparatus according to claim 6, comprising a plurality of emitter modules and an electrode having as many passage slits as there are emitter modules, all emitter modules and said electrode being connected to one single power supply unit, and the emitters being connected through a conduit system to one and the same supply vessel comprising a heater for liquifying the metal present therein, and in which liquid metal is supplied to all emitters through said conduit system. (FIG. 11)

8. Apparatus according to claim 7, in which each emitter module is provided with a heating element that can be switched on and off for melting the metal in said emitter module.

9. A field-emission ion source as claimed in claim 2, in which the emitter module is provided with a heating element, there being further provided means for supplying to said emitter module a metal or alloy in the form of a wire or foil, which by means of the heating element is converted in the emitter cavity into a liquid propellant.

10. A field-emission ion source as claimed in claim 2, in which the outer walls of the two housing bodies are provided on opposite sides of the discharge slits with a coating suitable to prevent undesirable propellant creeping.

11. A field emission ion source as claimed in claim 2 in which the internal emitter surfaces are coated with a very thin solid propellant metal layer.

12. A field emission source, comprising a housing provided with a hollow-space acting as reservoir means for supplying liquid metal or metal alloy to said hollow space, means for creating a strong electric field, characterised in that the housing is provided with a capillary field emission slit having a width of no more than 0.020 mm.

* * * * *

UNITED STATES PATENT AND TRADEMARK OFFICE

CERTIFICATE OF CORRECTION

PATENT NO. : 4,328,667

DATED : May 11, 1982

INVENTOR(S) : Dominique R. Valentian et al.

It is certified that error appears in the above-identified patent and that said Letters Patent are hereby corrected as shown below:

Delete the list of inventors and substitute the following therefor:

Cesare M. Bartoli, Voorhout, Netherlands;
Heinrich A. Pfeffer, Noordwijk, Netherlands;
Hans-Joachim Herhudt V. Rohden, Oegstgeest, Netherlands,
Dominique R. Valentian, Mantes la Jolie, France;
Duncan Stewart, Slough, England Signed and Sealed this

*Twenty-third* Day of *April 1985*

[SEAL]

*Attest:*

DONALD J. QUIGG

*Attesting Officer* *Acting Commissioner of Patents and Trademarks*